United States Patent [19]

Woycheese

[11] 4,121,665

[45] Oct. 24, 1978

[54] AUTOMATIC SPRINKLER HEAD

[75] Inventor: John E. Woycheese, Charlotte, N.C.

[73] Assignee: Standard Fire Protection Equipment Co., Charlotte, N.C.

[21] Appl. No.: 560,553

[22] Filed: Mar. 20, 1975

[51] Int. Cl.[2] ..... A62C 37/14

[52] U.S. Cl. ..... 169/38; 239/DIG. 4

[58] Field of Search ..... 169/37, 38, 41; 137/533, 70, 71, 74, 334; 239/DIG. 4; 277/95

[56] References Cited

U.S. PATENT DOCUMENTS

| | | | |
|---|---|---|---|
| 1,943,480 | 1/1934 | Hodgman, Jr. | 169/38 |
| 1,996,077 | 4/1935 | Loepsinger | 169/38 |
| 2,469,832 | 5/1949 | Lewis | 169/38 |
| 2,528,063 | 10/1950 | Loepsinger | 169/38 |
| 2,946,519 | 7/1960 | Bellman | 239/DIG. 4 |
| 3,272,218 | 9/1966 | Johnson | 251/332 X |
| 3,403,698 | 10/1968 | Klun | 251/334 X |
| 3,443,572 | 5/1969 | Lavigne, Jr. et al. | 137/70 |
| 3,757,866 | 9/1973 | Mears et al. | 169/37 |

*Primary Examiner*—Robert R. Song
*Assistant Examiner*—Michael Mar
*Attorney, Agent, or Firm*—Richards, Shefte & Pinckney

[57] ABSTRACT

An automatic sprinkler head of the type wherein a frangible bulb member is held in a frame between an adjustable retainer and a valve member normally seated in a bore provided in the frame and supplied with a fire extinguishing fluid. The valve member is of unitary construction, and is formed with an annular flat surface portion disposed in facing relation to a corresponding annular flat surface portion formed in the frame about its bore. A resilient ring element is disposed directly between the aforesaid facing surface portions to seal the bore and to provide a yieldable support for the valve member. The valve member has dimensions which permit it to be freely movable within the frame seat, and the ring element is maintained between the valve member and the frame seat by the structural formations thereof.

7 Claims, 3 Drawing Figures

AUTOMATIC SPRINKLER HEAD

BACKGROUND OF THE INVENTION

Automatic sprinkler systems are used extensively in buildings and the like for the purpose of providing a supply of fire extinguishing fluid such as water which will automatically be released by the system when the system is exposed to a predetermined elevated temperature at which the system is designed to be activated. Such automatic sprinkler systems generally include conduits supplied with a fire extinguishing fluid under pressure, and a plurality of automatic sprinkler heads which are individually fitted in the conduits and which include a normally closed valve member and a temperature responsive element that will permit the valve member to be opened by the fluid pressure in the supply conduit when a predetermined temperature is reached, thereby resulting in the fire extinguishing fluid being dispersed throughout a surrounding area.

One of the most commonly used temperature responsive elements is a frangible bulb made of quartz and filled with a bursting charge of fluid which will expand and burst the frangible bulb when the temperature of the charge is raised to a predetermined level, a frangible bulb of this type being disclosed in U.S. Pat. No. Re. 16,132. Such frangible bulbs are generally mounted in a sprinkler head frame so as to bear against a valve member and hold the valve member in place and thereby close the bore at which pressurized fire extinguishing is present, typical arrangement of this sort being described in U.S. Pat. Nos. 2,046,169 and 2,528,063.

The aforementioned frangible bulbs are quite reliable in operation but care must be exercised in providing a suitable mounting for the bulb because of the frangible nature of the bulb and the fact that the bulb must be able to withstand and transmit to the valve member a force that is sufficient to maintain the valve member at its closed position in the frame bore in opposition to the pressure exerted against the valve member by the pressurized fire extinguishing fluid (e.g. 500 psi). Additionally, the frangible bulb must be mounted in such a way that it will not inadvertently break when the sprinkler head is subjected to relatively minor shocks and vibrations, such as might be expected during installation of the sprinkler head.

In an effort to overcome the aforementioned difficulties encountered in properly mounting a frangible bulb in a sprinkler head, some prior art sprinkler heads, such as that shown in U.S. Pat. No. 2,469,832, utilized a plurality of separable liners and gaskets which are made from a metal such as copper and which are disposed between the valve member and the frangible bulb, and between the valve member and its seat, to soften somewhat the effect of the compressive force exerted against the bulb and to increase the sealing capacity of the valve member. However, these copper liners and gaskets increase the cost of the sprinkler heads, and they render assembly of the sprinkler head more difficult, and the metal-to-metal sealing contact is sometimes ineffective, particularly when the fire extinguishing fluid is under a relatively high pressure.

It has also been heretofore proposed to provide the sprinkler head with a valve member having a built-in, relatively complex spring assembly such as disclosed in U.S. Pat. No. 1,996,077, to provide a resilient mounting for the frangible bulb, and a metal gasket is provided at the valve seat to increase the sealing characteristics of the valve member. Such complex valve member constructions are relatively expensive to produce, and somewhat difficult to assemble in place.

Finally, U.S. Pat. No. 3,253,657 discloses a sprinkler head having a frame formed with a flexible, annular protrusion that provides a yieldable flange for supporting a valve body made from Teflon and including a sealing ring that engages the annular protrusion of the frame. While the valve member itself has a simple construction, the frame must be specially formed with the thin annular protrusion, and this protrusion is vulnerable to breakage, particularly during shipment and installation of the sprinkler head.

By substantial contrast, the sprinkler head of the present invention is extremely simple and inexpensive to produce, yet it is very reliable and it combines excellent sealing characteristics with a yieldable support for the frangible bulb.

SUMMARY OF THE INVENTION

In accordance with the present invention, an automatic sprinkler head is provided which includes a frame, and a frangible bulb element supported in the frame by an adjustable retainer engaging one end of the frangible bulb and by a valve member engaging the other end of the frangible bulb while being seated in a frame bore supplied with a pressurized fire extinguishing fluid to normally maintain such bore closed. The valve member has a unitary construction and is formed with a flat continuous surface portion located in facing relation with a corresponding flat continuous surface portion formed in the frame seat about the bore, and a ring element of resilient material is disposed directly between these facing flat surface portions to provide an effective seal therebetween while simultaneously providing a yieldable support for the valve member and the frangible bulb member engaged thereby.

The unitary valve member is arranged to be disposed within the seat of the frame, and it is dimensioned so as to have a peripheral clearance with respect to the seat whereby it is freely movable with respect thereto. The adjustable retainer is selectively movable with respect to the frame in a direction toward and away from the frame seat so as to be capable of exerting a compressive force on the ring element, such force being transmitted through the frangible bulb member and the freely movable valve member.

The valve member is preferably formed with a stepped configuration which includes the aforementioned flat continuous surface portion and a circular surface portion intersecting such flat surface portion in perpendicular relation thereto, and the frame seat is likewise formed with a corresponding stepped configuration that includes a flat surface portion and a circular surface portion intersecting such flat surface portion in perpendicular relation thereto. When the valve member is located at the frame seat, the corresponding flat surface portions of both such parts are disposed in spaced facing relation, and the corresponding circular surface portions are likewise disposed in spaced facing relation, to thereby form an enclosed annular space for retaining the resilient ring between the valve member and the frame seat.

Additionally, the circular surface portion of the valve member has an axial depth which is less than the axial depth of the frame seat circular wall portion and which is less than the thickness of the ring element when a normal compressive force is exerted thereagainst whereby the valve member will always be freely movable with respect to the frame seat to provide the aforementioned yieldable support for the frangible bulb member.

DESCRIPTION OF THE PREFERRED EMBODIMENT

Figure 1:
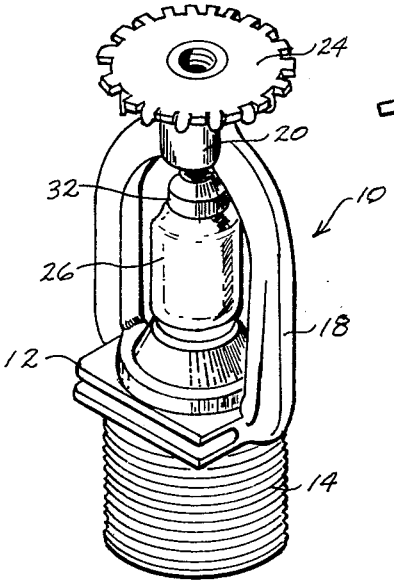
FIG. 1 is a perspective view of the automatic sprinkler head of the present invention.
Figure 2:
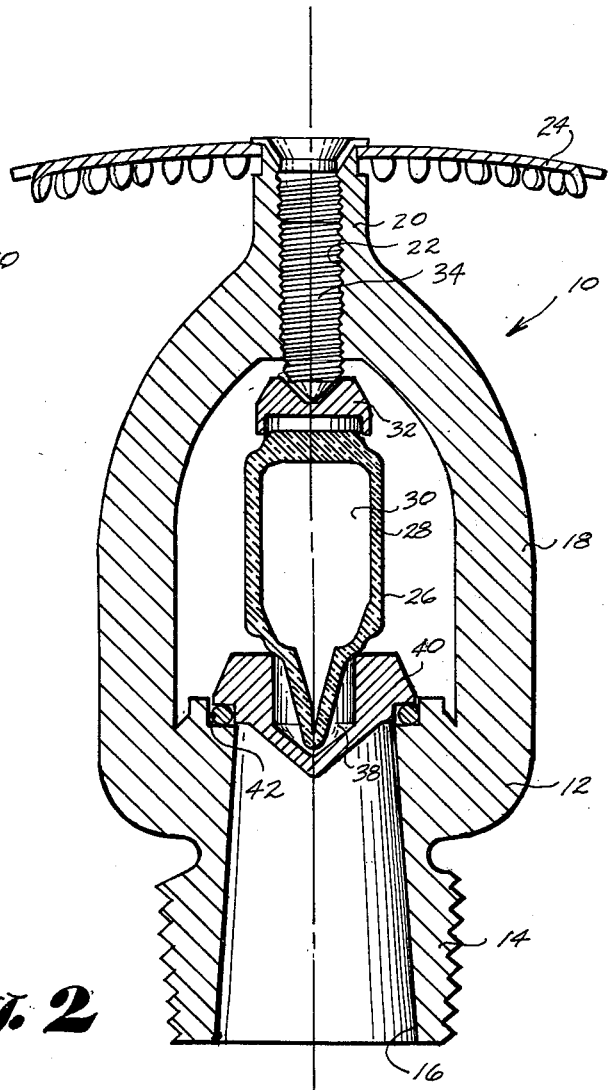
FIG. 2 is a vertical sectional view of the automatic sprinkler head shown in FIG. 1, taken along the axial centerline thereof.
Figure 3:
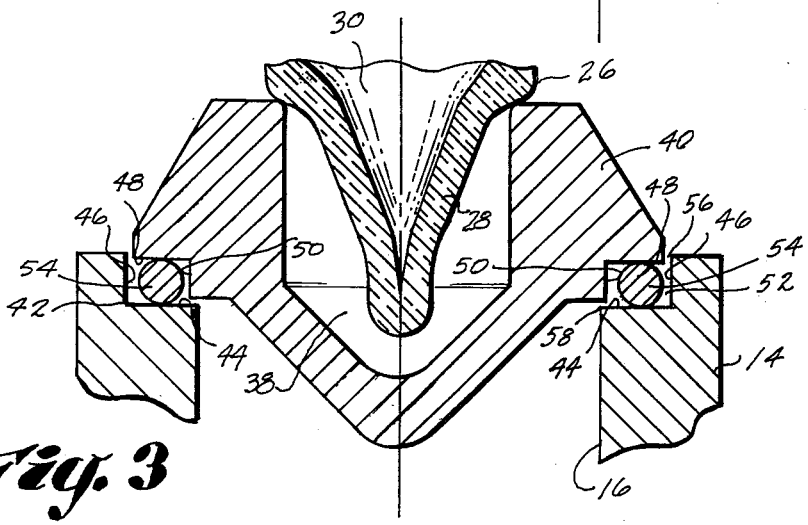
FIG. 3 is a detail sectional view illustrating the valve member and the frame seat of the automatic sprinkler head shown in FIG. 1.

Looking now in greater detail at the accompanying drawings, FIGS. 1–3 illustrate an automatic sprinkler head 10 constructed in accordance with the present invention. The sprinkler head 10 includes a frame 12 having a threaded base portion 14 formed with a cylindrical bore 16, the threaded base portion 14 being adapted to be fitted into a supply conduit (not shown) containing a fire extinguishing fluid such as water which flows from the supply conduit into the bore 16. The frame 12 includes a bifurcated yoke 18 extending from the base portion 14 to an upstanding connection 20 formed with a threaded bore 22 which is axially aligned with the cylindrical bore 16. A deflector plate 24 is attached to the upstanding connection 20 so as to be in a plane above the cylindrical bore 16 and in perpendicular relation to the axis thereof whereby fluid exiting from the bore 16 under pressure will strike the deflector plate 24 and be propagated over a wide area.

Mounted within the frame 12 is a conventional frangible bulb 26 which includes an enclosed vessel 28 made from quartz or another suitable material having a low coefficient of expansion, and this vessel 28 is filled with a bursting charge of an expansible liquid 30 such as carbon tetrachloride which, when heated to a predetermined temperature will expand sufficiently to burst the vessel 28. As best seen in FIG. 2, the upper end of the frangible bulb 26 is engaged and held by a domed retainer element 32 mounted on the end of a set screw 34 threadably received in the threaded bore 22, the set screw 34 being provided with a flat sided opening (not shown) for receiving an Allen wrench to adjust the longitudinal position of the set screw 34 and the retainer element 32 secured thereto. The other end of the frangible bulb 26 is received in and engaged by a recess 38 formed in a valve member 40 disposed in the cylindrical bore 16 to normally close the same and prevent the pressurized fire extinguishing fluid from leaving the cylindrical bore 16.

As best illustrated in FIG. 3, the frame 12 is formed with a seat 42 surrounding the cylindrical bore 16 and having a stepped configuration to present a flat, annular surface portion 44 lying in a plane that is perpendicular to the axis of the cylindrical bore and to present a circular surface portion 46 intersecting the flat surface portion 44 in perpendicular relation thereto. The valve member 40 is likewise formed with a stepped configuration providing a flat, annular surface portion 48 lying in a plane that is perpendicular to the axis of the cylindrical bore 16, and a circular surface portion 50 intersecting the flat surface portion 48 is perpendicular relation thereto. When the valve member 40 is properly disposed within the cylindrical bore 16 at the frame seat 42, the corresponding flat surface portions 44 and 48 are disposed in spaced facing relation, and the corresponding circular surface portions 46 and 50 are likewise disposed in spaced facing relation, to thereby form a generally enclosed annular chamber 52 between the valve member 40 and the frame seat 42 as shown in FIG. 3. An O-ring 54, formed of a resilient material, is located within the annular chamber 52 and is disposed directly between, and in contact with, the facing flat surface portions 44 and 48.

As will be explained in greater detail presently, it is a feature of the present invention that the valve member 40 is freely movable with respect to the frame 12 and the frame seat 42. Pursuant to this end, the valve member 40 is dimensioned so that the portion thereof disposed at the frame seat 42 has a width which is less than the maximum width of the frame seat 42 to provide peripheral clearance therebetween, as indicated by the reference numeral 56 in FIG. 3. More specifically, the radius of curvature of the frame seat circular surface 46 is greater than the radius of the valve member flat surface portion 48, measured at the outer periphery thereof. In a typical embodiment of the present invention, the radius of curvature of the frame seat circular surface 46 is 0.35-inch whereas the radius of the valve member flat surface portion 48 is 0.347-inch, at the outer periphery thereof, thereby providing a peripheral clearance of 0.003-inch. Additionally, the radius of curvature of the valve member circular surface portion 50 is greater than the radius of the frame seat flat surface portion 44 at the inner periphery thereof so that such circular surface portion 50 will be disposed within the radial extent of the frame seat flat surface portion 44. Typically, the radius of curvature of the circular surface portion 50 may be 0.275-inch, and the flat surface portion 44 will have a radius at the inner periphery thereof of 0.219-inch for a ½ inch pipe thread size sprinkler head or 0.258 for a ¾ inch pipe thread size sprinkler head to provide an overlap of 0.056-inch or 0.017-inch, respectively.

It is also desirable to assure that the valve member 40, during movement thereof with respect to the frame seat 42, not strike or come into contact with the flat surface portion 44 of the frame seat 42. Accordingly, the depth of the frame seat circular surface portion 46, measured in the direction of the axis of the cylindrical bore 16, is at least as great as the thickness of the O-ring 54 in its uncompressed state so that the O-ring 54 will be readily accommodated within the frame seat 42, and the corresponding axial depth of the valve member circular surface portion 50 is less than the axial depth of the frame seat circular surface portion 46 and is less than the thickness of the O-ring 54 when it is compressed to provide sealing between the valve member 40 and the frame seat 42. In the aforementioned typical embodiment of the present invention, the O-ring 54 has an uncompressed thickness of 0.07-inch, the frame seat circular surface portion 46 has an axial depth of 0.1-inch, and the valve member circular surface portion 50 has an axial depth of 0.049-inch. Since in normal usuage, the O-ring 54 is not compressed to a thickness of less than 0.05-inch, a clearance is always provided between the lower edge of the valve member circular surface portion 50 and the frame seat flat surface portion 44, this clearance being indicated by the reference numeral 58 in FIG. 3.

The operation of the automatic sprinkler head 10 of the present invention is as follows. The sprinkler head 10 is assembled as shown in FIG. 1 and FIG. 2, and it is then mounted to a supply conduit so that fire extinguishing fluid under pressure may be admitted to the cylinrical bore 16. It will be noted that, in assembling the sprinkler head 10, the O-ring 54 is simply placed on the frame seat circular surface portion 46, after which the valve member 40, which is of unitary construction, may be disposed in the frame seat 42 with the O-ring 54 disposed in the annular chamber 52. This operation is much simplier than in some of the prior art sprinkler heads described above which include a plurality of valve member parts. The set screw 34 and attached retainer element 32, which are selectively movable toward and away from the frame seat 42, is then adjusted downwardly, as seen in FIG. 2, to transmit a compressive force on the O-ring 54 through the frangible bulb 26 and the valve member 40. This force will compress the O-ring 54 by a desired amount so that an excellent seal is provided between the valve member 40 and the frame seat 42 up to pressures of at least 500 psi, and it will be observed that the peripheral clearance 56 and the axial clearance 58 between the valve member 40 and the frame seat 42 render the valve member 40 freely movable with respect to the frame seat 42 as the O-ring 54 is compressed. Also, the substantially enclosed annular chamber 52 always contains fully the O-ring 54 to prevent any inadvertent slipping or displacement of the O-ring which could adversely affect its sealing capability.

In addition to providing an excellent seal, the O-ring 54 also provides a yieldable support for the valve member 40 and the frangible bulb 26 engaged thereby. Keeping in mind that the vessel 28 of the frangible bulb 26 can be inadvertently broken if it is subjected to any significant shock force occurring during installation or use of the sprinkler head, the substantial advantage of the cushioning effect provided by the yieldable O-ring 54 will be readily apparent. Moreover, since the valve member 40 has peripheral and axial clearance with respect to the frame seat 42, even when the O-ring 54 is at sealing compression, the valve member 40 is movable with respect to the frame seat 42 and is fully capable of transmitting any shock forces or the like to the yieldable O-ring 54 rather than permitting such force to be exerted against the frangible bulb 26. Finally, as compared with prior art metal-to-metal seals, a lesser force is required to compress the O-ring 54 to sealing compression, thereby reducing the force which must be transmitted through the frangible bulb 26.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. An automatic sprinkler head including a frame provided with a bore connectable to a supply line containing a fire extinguishing fluid, said frame being formed with a seat having a flat continuous surface portion extending around the periphery of said bore, a frangible bulb member, retaining means associated with said frame and engaging one end of said bulb member, a valve member engaging said bulb member at the other end thereof, said valve member having formed with a flat continuous surface portion located in said bore at said seat with said corresponding flat surface portions of said valve member and said seat being disposed in facing relation, the portion of said valve member disposed at said frame seat having a width that is less than the width of said seat to provide peripheral clearance therebetween, whereby said valve member is freely movable with relation to said seat, and a shock absorbing ring element formed of resilient material and disposed in said bore directly between and in contact with said facing flat surface portions of said valve member and said seat, said ring element being the sole connection between said frame and said valve member to provide a seal therebetween and to provide a yieldable shock absorbing support for said valve member and bulb member.

2. An automatic sprinkler head as defined in claim 1 and further characterized in that said retaining means is selectively movable with respect to said frame in a direction toward and away from said frame seat so as to be capable of exerting a compressive force on said ring element through said bulb member and said valve member.

3. An automatic sprinkler head as defined in claim 1 and further characteriziaed in that said facing surface portions of said valve member and said frame seat each have an annular extent and each lies in a plane disposed perpendicularly with respect to the axis of said bore, in that said frame seat is formed with a stepped configuration having a circular surface portion intersecting said flat surface portion thereof in perpendicular relation thereto, in that said valve member has a stepped configuration including a corresponding circular surface portion intersecting said flat surface portion thereof in perpendicular relation thereto, in that said circular surface of said frame seat is disposed in spaced facing relation to the circular surface of said valve member, and in that said ring element is retained between said stepped surface configuration of said frame seat and said valve member.

4. An automatic sprinkler head as defined in claim 3 and further characterized in that the axial depth of said frame seat circular surface portion is at least as great as the thickness of said ring element and is greater than the axial depth of said valve member circular surface portion.

5. An automatic sprinkler head as defined in claim 4 and further characterized in that said retaining means is selectively movable with respect to said frame in a direction toward and away from said frame seat to thereby exert a compressive force against said ring element through said bulb member and said valve member, and in that the axial depth of said valve member circular surface portion is less than the thickness of said ring element when said compressive force is exerted thereagainst.

6. An automatic sprinkler head as defined in claim 3 and further characterized in that the radius of curvature of said frame seat circular surface is greater than the radius of said valve member flat surface portion at the outer periphery thereof to provide a radial clearance between said valve member and said frame seat.

7. An automatic sprinkler head as defined in claim 6 and further characterized in that the radius of curvature of said valve member circular surface portion is greater than the radius of said frame seat flat surface portion at the inner periphery thereof whereby said valve member circular surface portion will be disposed within the radial extent of said frame seat flat surface portion.

* * * * *

UNITED STATES PATENT OFFICE

CERTIFICATE OF CORRECTION

Patent No. 4,121,665 Dated October 24, 1978

Inventor(s) John E. Woycheese

It is certified that error appears in the above-identified patent and that said Letters Patent are hereby corrected as shown below:

Column 3, line 67, delete "is" and insert therefor --in--. Column 5, line 6, delete "cylinrical" and insert therefor --cylindrical. Column 5, line 67, delete "having" and insert therefor --being--.

Signed and Sealed this

*Third* Day of *July 1979*

[SEAL]

*Attest:*

*Attesting Officer*

LUTRELLE F. PARKER

*Acting Commissioner of Patents and Trademarks*